US006719173B2

(12) United States Patent
Safian

(10) Patent No.: US 6,719,173 B2
(45) Date of Patent: Apr. 13, 2004

(54) MULTILAYER CONTAINER PACKAGE FOR DISPENSING A LIQUID PRODUCT

(75) Inventor: John W. Safian, Maumee, OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 10/105,730

(22) Filed: Mar. 25, 2002

(65) Prior Publication Data

US 2003/0178445 A1 Sep. 25, 2003

(51) Int. Cl.[7] ..... B65D 35/56

(52) U.S. Cl. ..... 222/105; 222/209; 222/386.5; 222/481.5

(58) Field of Search ..... 222/105, 212, 222/209, 215, 386.5, 481.5; 215/11.5

(56) References Cited

U.S. PATENT DOCUMENTS

| | | | | |
|---|---|---|---|---|
| 2,715,980 A | | 8/1955 | Frick | |
| 4,154,366 A | | 5/1979 | Acres | |
| 4,295,582 A | | 10/1981 | Acres | |
| 4,657,151 A | | 4/1987 | Cabernoch | |
| 4,760,937 A | | 8/1988 | Evezich | |
| 4,842,165 A | | 6/1989 | Van Coney | |
| 4,909,416 A | | 3/1990 | Evezich | |
| 4,966,543 A | | 10/1990 | Krishnakumar | |
| 5,012,956 A | | 5/1991 | Stoody | |
| 5,275,311 A | | 1/1994 | Piarrat | |
| 5,301,838 A | | 4/1994 | Schmidt | |
| 5,303,852 A | * | 4/1994 | Yamawaki et al. | 222/209 |
| 5,318,204 A | | 6/1994 | Davis | |
| 5,332,121 A | | 7/1994 | Schmidt | |
| 5,407,629 A | | 4/1995 | Schmidt | |
| 5,435,452 A | | 7/1995 | Nishigami | |
| 5,487,490 A | | 1/1996 | Estes | |
| 5,680,966 A | | 10/1997 | Johnson | |
| 5,687,882 A | | 11/1997 | Mueller | |
| 5,699,920 A | | 12/1997 | Ida | |
| 6,238,201 B1 | | 5/2001 | Safian | |
| 6,446,822 B1 | * | 9/2002 | Meyers et al. | 215/11.5 |

FOREIGN PATENT DOCUMENTS

| | | |
|---|---|---|
| EP | 1092632 | 4/2001 |

* cited by examiner

*Primary Examiner*—Philippe Derakshani

(57) ABSTRACT

A package for dispensing a liquid product that includes an outer shell having a flexible resilient sidewall, a base wall and a finish surrounding an outlet opening. An inner bag-shaped liner is disposed within the outer shell, and is unattached to the sidewall and the base wall of the outer shell so as to be collapsible with respect to the outer shell as product is dispensed from the liner. A dispensing structure is secured to the finish. An opening in the base wall of the outer shell vents the volume between the shell and the liner to atmosphere. An atmospheric vent valve includes a base secured over the base wall of the outer shell, a valve pocket within the base having an atmospheric vent opening, and a valve disk received in the valve cup so that air pressure holds the valve disk against the base over the atmospheric vent opening when the container sidewall is squeezed.

13 Claims, 5 Drawing Sheets

MULTILAYER CONTAINER PACKAGE FOR DISPENSING A LIQUID PRODUCT

The present invention is directed to a liquid dispensing package that includes a flexible resilient outer shell and a collapsible inner liner for holding the liquid product, and more particularly to techniques for venting the space or volume between the liner and the shell as product is dispensed and the liner collapses.

BACKGROUND AND SUMMARY OF THE INVENTION

U.S. Pat. Nos. 6,083,450 and 6,238,201 disclose a multilayer container that includes an outer plastic shell and a plastic inner liner for holding product to be dispensed. As product is dispensed from the package, the inner liner pulls away from the outer shell and collapses. An atmospheric vent is disposed in the bottom wall of the shell for venting the volume between the liner and the shell to atmosphere so that the outer shell retains its geometry or configuration while the inner liner collapses as product is dispensed. It is a general object of the present invention to provide improved techniques for venting the space or volume between the shell and the liner.

A package for dispensing a liquid product in accordance with a first aspect of the present invention includes an outer shell having a flexible resilient sidewall, a base wall and a finish surrounding an outlet opening. An inner liner is disposed within the outer shell, and is unattached to the sidewall and the base wall of the outer shell so as to be collapsible with respect to the outer shell as product is dispensed from within the liner. A dispensing structure is secured to the container finish. An open orifice in the base wall of the outer shell is sized to prevent rapid egress of air through the orifice in response to squeezing of the container sidewall so that pressure on the liner from squeezing the sidewall forces product from within the liner out of the outlet opening and the dispensing structure. The open orifice is sized to permit slow ingress of ambient air into the shell in response to release of the sidewall to vent the volume between the sidewall and the liner and permit the sidewall to return to its unsqueezed configuration.

A package for dispensing a liquid product in accordance with another aspect of the present invention includes an outer shell having a flexible resilient sidewall, a base wall and a finish surrounding an outlet opening. An inner liner is disposed within the outer shell, and is unattached to the sidewall and the base wall of the outer shell so as to be collapsible with respect to the outer shell during dispensing of product within the liner. A dispensing closure is secured to the finish. The closure includes a dispensing opening for dispensing product from within the liner when the package is inverted and the shell sidewall is squeezed. An open orifice in the base wall of the outer shell is sized to prevent rapid egress of air through the orifice in response to squeezing of the container sidewall so that the pressure on the liner from squeezing the sidewall condenses the air volume and forces product within the liner out of the outlet opening and the dispensing opening. The orifice is sized to permit slow ingress of ambient air into the shell in response to release of the sidewall to permit the sidewall to return to its unsqueezed configuration.

A package for dispensing a liquid product in accordance with a further aspect of the invention includes an outer shell having a flexible resilient sidewall, a base wall, a finish surrounding an outlet opening, and an opening in the base wall. A liner is disposed within the outer shell, and is unattached to the sidewall and the base wall of the outer shell so as to be collapsible with respect to the outer shell as product is dispensed from the liner. A dispensing structure is secured to the container finish. An atmospheric valve assembly comprises a base secured over the base wall of the outer shell, a valve pocket in the base having an atmospheric opening, and a valve disk in the pocket. In this embodiment, squeezing of the sidewall of the outer shell will urge the valve disk over the atmospheric opening in the base and force product from the liner through the outlet opening and the dispensing structure. Release of the sidewall will release the valve disk so that ambient air can flow through the atmospheric vent and the base wall opening to permit the sidewall to return to its unsqueezed configuration.

A package for dispensing liquid product in accordance with yet another aspect of the invention includes an outer shell having a flexible resilient sidewall, a base wall, a finish surrounding an outlet opening and an opening in the base wall. An inner liner is disposed within the outer shell, and is unattached to the sidewall and the base wall of the outer shell so as to be collapsible with respect to the outer shell to dispense product from within the liner. A dispensing closure is secured to the finish, and includes an outlet opening for dispensing product from within the liner when the package is inverted and the shell sidewall is squeezed. An atmospheric valve assembly includes a base secured over the base wall of the outer shell, a valve pocket within the base having an atmospheric vent opening, and a valve disk in the pocket. The valve disk in this embodiment includes a central portion overlying the vent opening, a peripheral portion secured against the bottom wall of the valve pocket, and a plurality of flexible resilient spokes interconnecting the central and peripheral portions while permitting movement of the central portion with respect to the peripheral portion and the vent opening. In this embodiment, squeezing of the sidewall of the outer shell will urge the central portion valve disk over the atmospheric vent opening in the base to close the vent opening by the force of air within the shell and force product from the liner through the outlet opening and the dispensing closure. Release of the sidewall will release the central portion of valve disk so that ambient air can be drawn through the atmospheric vent opening and the opening in the base wall to permit the sidewall to return to its unsqueezed configuration.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
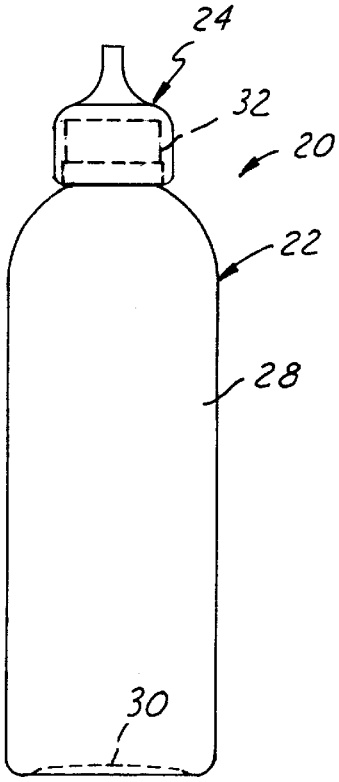
FIG. 1 is a side elevational view of a dispensing package in accordance with one presently preferred embodiment of the invention.
Figure 2:
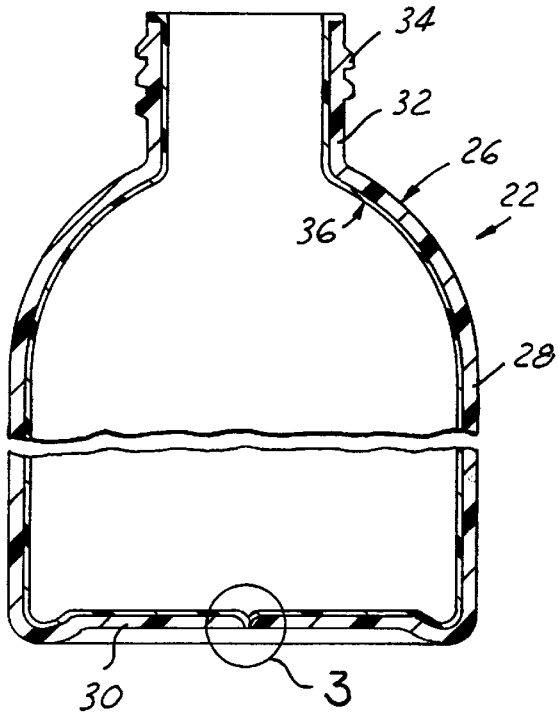
FIG. 2 is a fragmentary sectional view of the container in the package of FIG. 1.
Figure 3:
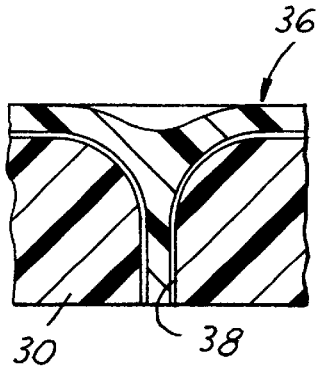
FIG. 3 is a fragmentary sectional view on an enlarged scale of the portion of FIG. 2 within the area 3.
Figure 4:
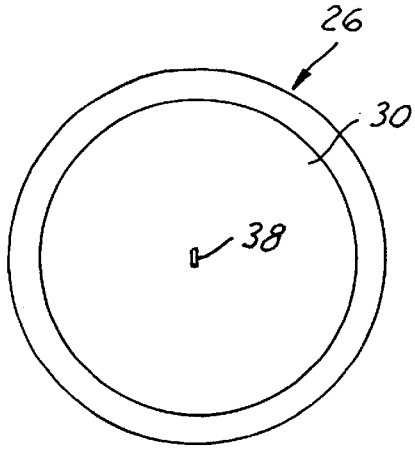
FIG. 4 is a bottom plan view of the container in FIGS. 1–3.

FIG. 1 illustrates a liquid dispensing package 20 in accordance with one presently preferred embodiment of the invention as comprising a container 22 and a dispensing closure 24. Referring to FIGS. 1–4, container 22 includes an outer shell 26 having a flexible resilient sidewall 28, a base wall 30 and a finish 32 surrounding and defining a mouth that forms an outlet opening from the container interior. Finish 32 has one or more external threads or beads 34 to which closure 24 is secured. An inner bag-shaped liner 36 is disposed within outer shell 26. Liner 36 is continuous throughout the interior of finish 32, sidewall 28 and bottom wall 30, being open at the container mouth for dispensing product. Liner 36 is unattached to sidewall 28 and bottom wall 30, and is collapsible with respect to the outer shell for dispensing product from within the liner. A vent opening 38 is formed in bottom wall 30 of outer shell 26, inner liner 36 being continuous over vent opening 38. Opening 38 preferably is centered in container bottom 30, as shown in FIG. 4. Container 22, including shell 26 and liner 36, preferably are formed in a plastic extrusion blow molding operation as described in above-noted U.S. Pat. No. 6,083,450, the disclosure of which is incorporated herein by reference. Shell 26 and/or liner 36 each may be of monolayer or multi-layer construction. At least the outer layer of liner 36 preferably is of a plastic material that is incompatible with the plastic material of the inner surface of shell 26 so that liner 36 is readily separated from shell 26 as product is dispensed from within the container. In one presently preferred embodiment of the invention, outer shell 26 includes an outer layer of LDPE, MDPE, HDPE or polypropylene, and an inner layer of polyethylene, HDPE and/or process regrind. Inner liner 36 includes an outer layer of EVOH or virgin nylon, and an inner layer of LLDPE or LPDE. In non-health-care applications, an adhesive in the amount of about 5% to 10% by weight can be mixed with the inner layer of the liner. In health-care applications, the adhesive may be provided as a separate layer between the inner and outer liner layers. See U.S. application Ser. No. 09/287,934 filed Apr. 7, 1999, the disclosure of which is incorporated herein by reference.

In accordance with one aspect of the present invention, in the embodiment of FIGS. 1–4, vent opening 38 in base wall 30 of shell 26 is a small orifice-size opening. That is, opening 38 is sufficiently small to prevent rapid egress of air through the opening in response to squeezing of container sidewall 28. In this way, the forces of squeezing sidewall 28 are primarily directed to squeezing liner 36 by compressing the air volume between the liner and the shell, and to dispensing product from within the liner through the dispensing opening of closure 24. If the sidewall squeezing forces remain constant, the air within the volume between shell 26 and liner 36 will eventually flow through opening 38 sufficiently that squeezing forces are no longer applied to the liner. When the container sidewall is released, air will slowly flow back into shell 26, between liner 36 and the inside surface of the shell, through small orifice-size opening 38. Package 20 is particularly useful for infrequent dispensing of product in droplet form, such as eye drops. Other applications include dispensing of liquid product in the form of a mist, a spray or a stream. Closure 24 has a dispensing opening that is sized to dispense liquid from within the package in droplet, spray or stream form, as desired. Closure 24 may comprise a dispensing closure as illustrated in U.S. Pat. No. 6,325,253, for example. In this embodiment of the invention, opening 38 preferably has a size in the range of about 0.0007 to 0.003 square inch. A rectangular opening 38 preferably has a length of about 0.125 inch, and a width of about 0.006 to 0.008 inch. A circular opening 38 preferably has a diameter of about 0.010 to 0.060 inch, and more preferably about 0.032 to 0.060 inch.

Figure 5:
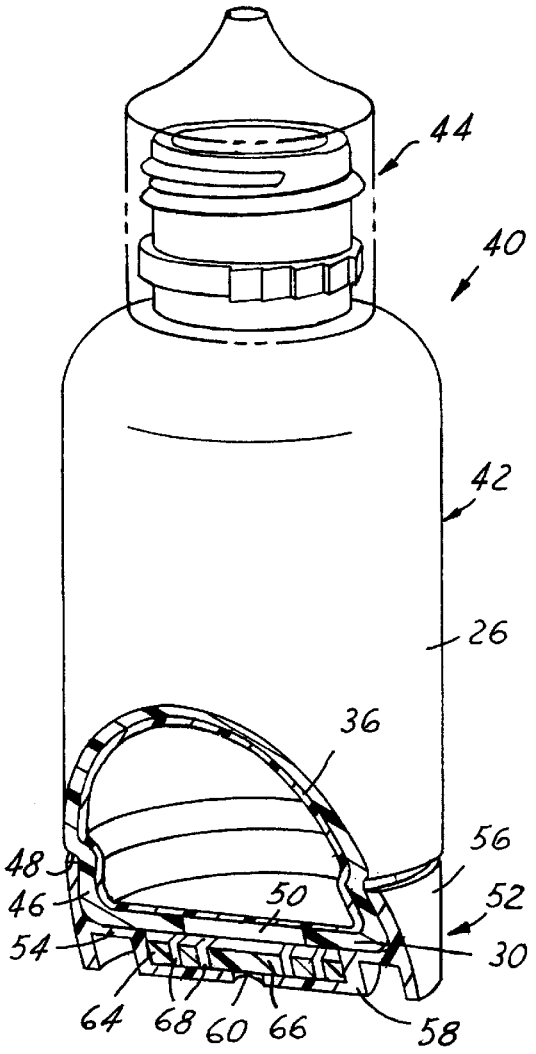
FIG. 5 is a partially sectioned perspective view of a dispensing package in accordance with another embodiment of the invention.

FIG. 5 illustrates a dispensing package 40 in accordance with another aspect of the invention as comprising a container 42 and a closure 44 secured over the finish 45 of the container. Container 42 includes a container body having an outer shell 26 and an inner bag-shaped liner 36, as in the embodiment of FIGS. 1–4. Again, the outer shell and/or the inner liner each may be of either monolayer or multilayer construction, for example employing materials discussed above in connection with FIGS. 1–4. Shell 26 has a lower end 46 formed by a cylindrical wall portion of reduced diameter as compared with the body of the shell. Lower end 46 is coaxial with body 26 and finish 45, forming an axially downwardly facing circumferentially continuous shoulder 48. (Directional words such as "upwardly" and "downwardly" are employed by way of description and not limitation with respect to the upright orientation of the packages illustrated in the drawings. Directional words such as "radially" and "laterally" are employed by way of description and not limitation with respect to the central axis of the container finish. All dimensions are nominal and are given by way of example.) A vent opening 50 is formed in bottom wall 30 of container shell 26. The container shell and liner may extrusion blow molded, and an elongated slot-shaped vent opening 50 may be formed as described above-referenced U.S. Pat. No. 6,083,450. A base 52 is secured to lower portion 46 of container body 42. Base 52 includes a flat deck 54 having an annular peripheral wall 56 that is telescopically received over portion 46 of the container sidewall with deck 54 in abutment with base wall 30 of outer shell 26. A recessed valve pocket 58 is centrally disposed in deck 54, extending away from the upper end of the base that is received over the container body. An opening 60 is centrally disposed in the flat bottom wall of pocket 58. Opening 60 has a diameter of 0.031 inch in one presently preferred but exemplary embodiment of the invention. Changing the size of opening 60 will control how rapidly outer shell 26 and sidewall 28 return to their normal or pre-squeezed geometries. For slower recovery, a smaller diameter opening 60 can be used, as small as 0.010 inch diameter.

Figure 6:
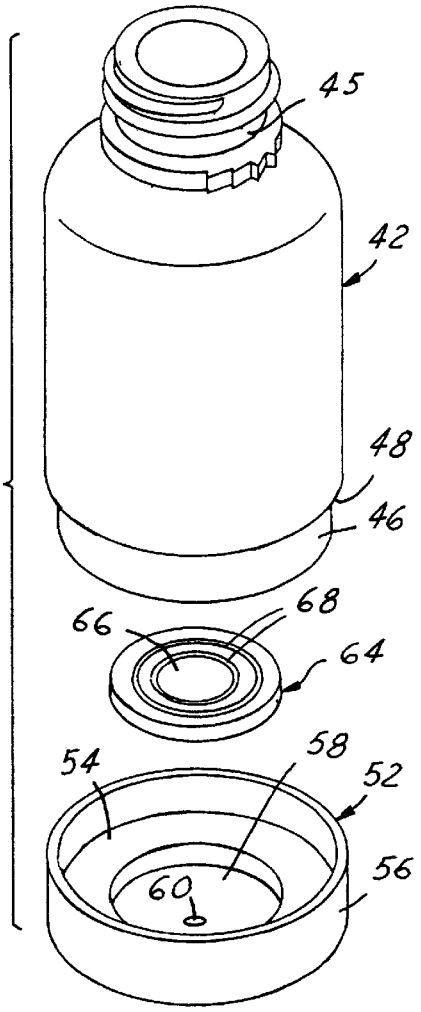
FIG. 6 is an exploded perspective view of the container in the package of FIG. 5.
Figure 7:
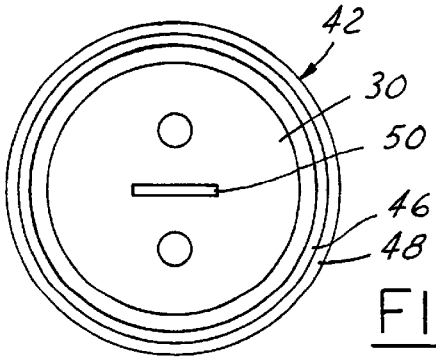
FIG. 7 is a bottom plan view of the container body in FIGS. 5–6.
Figure 9:
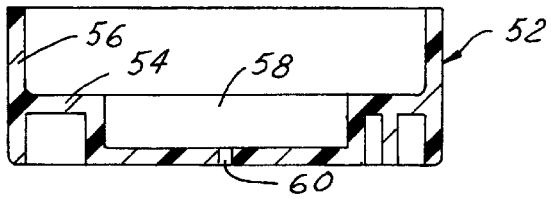
FIG. 9 is a section view taken substantially along the line 9—9 in FIG. 8.

A valve disk 64 is disposed within valve pocket 58. In the embodiment of FIGS. 5–7, valve disk 64 is loosely received in pocket 58 for bodily movement with respect to vent opening 60. Valve disk 64 is circular in geometry, having an imperforate central portion 66 of sufficient diameter to cover and close vent opening 60 in pocket 58, and having a plurality of arcuate openings 68 around central portion 66.

Valve disk 64 is retained within pocket 58 by reason of the fact that the upper end of the pocket is closed by base wall 30 of container shell 26. Base 52 may be spun-welded onto the lower end of the container shell, or may be secured to the lower end of the container shell by any other suitable mechanism such as laser welding or adhesive. In use, valve disk 64 is loosely received within pocket 58 of base 52, and base 52 is secured over lower portion 46 of container 42. That is, disk 64 is free floating in pocket 58 and not physically attached to base 52 in this embodiment. Closure 44, which may again be as illustrated in U.S. Pat. No. 6,325,253, is configured to dispense liquid in droplets, spray or stream when package 40 is inverted and the container sidewall is squeezed. When the sidewall is squeezed, the pressure of air between liner 36 and shell 26 urges valve disk 64 against the base of pocket 58 so that central portion 66 of disk 64 covers and closes opening 60 in pocket 58. Squeezing forces on the container sidewall are thus applied to the liner to dispense product within the liner through closure 44. When squeezing pressure is released, the resulting negative (sub-atmospheric) air pressure in the volume between shell 26 and liner 36 draws valve disk 64 away from the bottom wall of pocket 58 so that air enters opening 60 and flows through arcuate passages 68 and opening 50 in the bottom wall of shell 26 into the volume between the shell and the liner.

Figure 10:
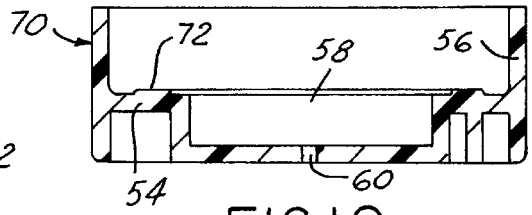
FIG. 10 is a sectional view similar to that of FIG. 9 but showing a modified base cup.
Figure 8:
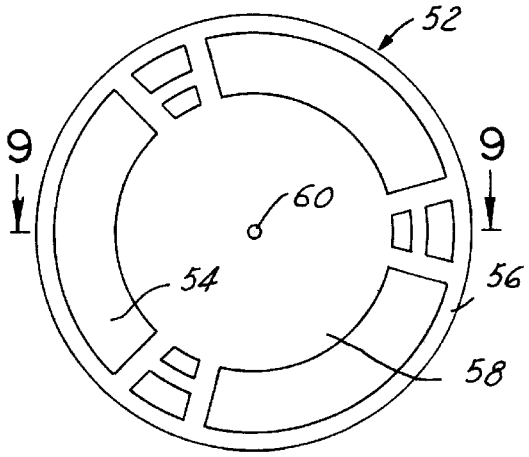
FIG. 8 is a bottom plan view of the atmospheric vent cup in the container of FIGS. 5–6.
Figure 11:
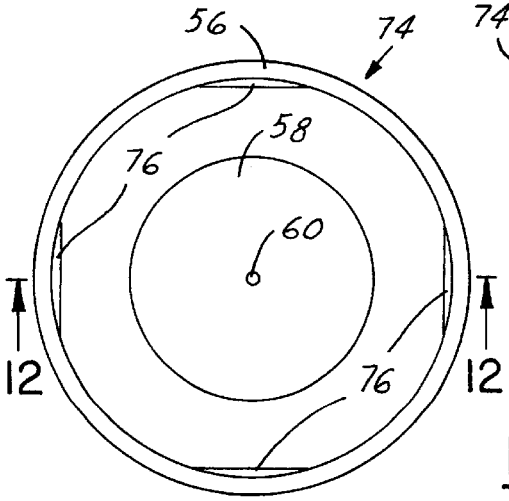
FIG. 11 is a top plan view of an atmospheric vent base cup in accordance with yet another embodiment of the invention.
Figure 12:
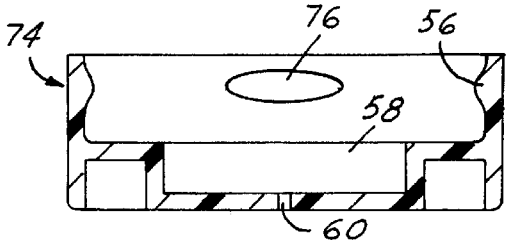
FIG. 12 is a sectional view taken substantially along the line 12—12 in FIG. 11.

FIG. 10 illustrates a modified base 70. In FIG. 10 (and FIGS. 11–16), reference numerals identical to those employed in connection with FIGS. 1–9 indicate identical or related components. Base 70 is similar to base 52 (FIGS. 5–9), but additionally includes an annular shoulder 72 that extends upwardly from deck 54 surrounding pocket 58. Shoulder 72 functions as an energy director when spin welding base 70 to the bottom wall 30 of container 42 (FIGS. 5–6). FIGS. 11–12 illustrate a base 74 having orthogonally positioned chordal beads 76 on the inside diameter of peripheral wall 56. Beads 76 may be received by snap fit in a corresponding channel around the lower end of the container outer shell to retain the base cup on the container.

Figure 13:
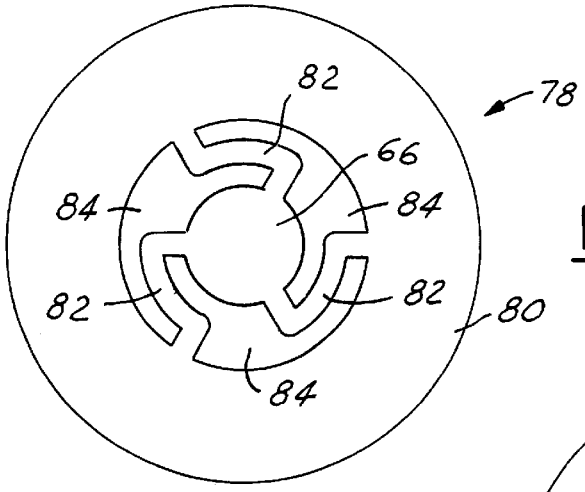
FIGS. 13–16 are top plan views of atmospheric vent valve disks in accordance with respective modified embodiments of the invention.
Figure 14:
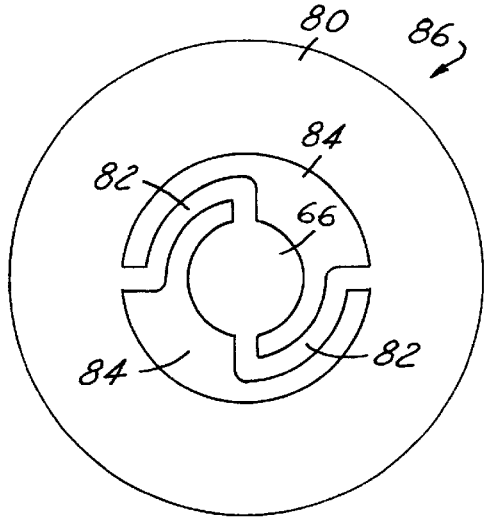
Figure 15:
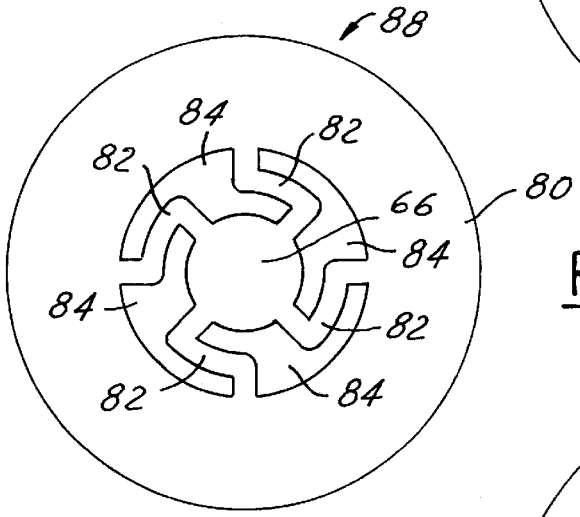
Figure 16:
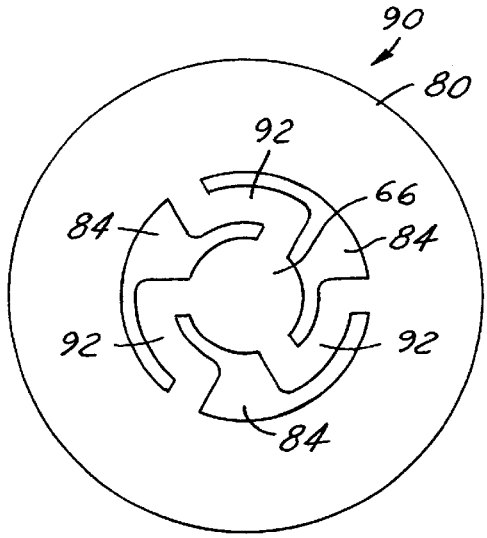
Figure 17:
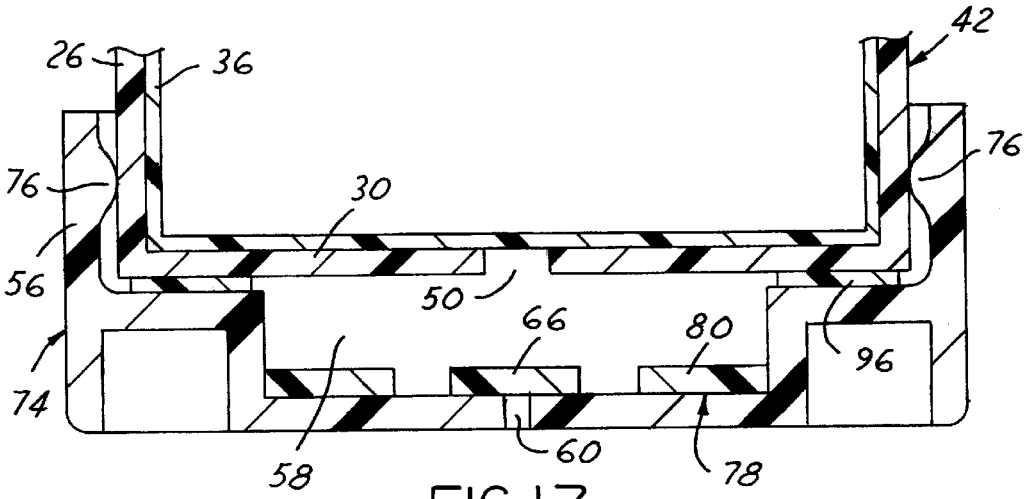
FIG. 17 is a fragmentary sectional view of a package in accordance with another embodiment of the invention.

FIG. 13 illustrates a modified valve disk 78, in which central portion 66 is mounted within an annular periphery 80 by a series of angularly spaced axially flexible and resilient S-shaped spokes 82. Spokes 82 serve the dual functions of movably mounting center portion 66 within periphery 80, and providing spaces 84 between the spokes for passage of air between base opening 60 (FIGS. 5–6 and 8–9) and outer shell vent slot 50 (FIGS. 5 and 7). FIG. 14 shows a valve disk 86 in which central portion 66 is mounted within periphery 80 by two S-shaped spokes 82, rather than three spokes as in the embodiment of FIG. 13. FIG. 15 illustrates a valve disk 88, in which central portion 66 is mounted within periphery 80 by four S-shaped spokes 82. FIG. 16 illustrates a valve disk 90, which is similar to valve disk 78 in FIG. 13 except that the S-shaped spokes 92 in FIG. 16 are wider than those in FIG. 13. Valve disks 78, 86, 88, 90 are flat and may have a uniform thickness on the order of 0.020 inch, for example. In each of these embodiments, the peripheral portion of the valve disk is secured within the base against the bottom wall of the valve pocket, such as by press fit, adhesive or welding. The central portion of the valve disk is flexibly and resiliently mounted by the spokes to hold the central portion of the disk over the vent opening when the container is squeezed, and to permit resilient axial movement of the central portion away from the vent opening due to negative pressure when the package is released. The S-shaped geometries of the resilient spokes is particularly advantageous.

FIG. 15 illustrates a package 94 that includes a container 42 (FIGS. 5–7), a base 74 (FIGS. 11–12), and a valve disk 78 (FIG. 13, or 86 in FIG. 14, or 88 in FIG. 15 or 90 in FIG. 16). A thin gasket 96 is positioned between disk 54 of base 42 and bottom wall 30 of container 42. Gasket 96 is preferably of soft plastic material such as polyethylene, and provides an area for laser-weld securement of the base up to the container. Peripheral portion 80 of valve disk 78 is secured to the base against the bottom wall of the valve pocket, while central portion 66 is free to move with respect to vent opening 60 as previously described. Beads 76 in the base function for temporary retention and centering of the base prior to welding.

There has thus been disclosed a package for dispensing a liquid product that fully satisfies all of the objects and aims previously set forth. The invention has been disclosed in conjunction with two presently preferred embodiments of the invention, and a number of modifications and variations have been discussed. Other modifications and variations will readily suggest themselves to persons of ordinary skill in the art. The invention is intended to embrace all such modifications and variations as fall within the spirit and broad scope of the appended claims.

What is claimed is:

1. A package for dispensing a liquid product, which comprises:

an outer shell having a flexible resilient sidewall, a base wall, a finish surrounding an outlet opening, and an opening centrally disposed in said base wall, an inner liner disposed within said outer shell, said inner liner being unattached to said sidewall and said base wall of said outer shell, and being collapsible with respect to said outer shell to dispense product within said liner, a dispensing closure secured to said finish, including a dispensing opening for dispensing product from within said liner when said package is inverted and said shell sidewall is squeezed, and an atmospheric valve assembly comprising a base secured over said base wall of said outer shell, a valve pocket within said base having a bottom wall with an atmospheric vent opening, and a valve disk in said valve pocket, said valve disk being flat and of uniform thickness, having a central portion for covering said vent opening, a peripheral portion secured within said valve pocket against said bottom wall, and a plurality of flexibly resilient spokes interconnecting said central and peripheral portions to permit movement of said central portion with respect to said peripheral portion and said vent opening, spaces between said spokes permitting passage of air from said vent opening in said base wall when said disk is paced from said vent opening.

2. The package set forth in claim 1 wherein said spokes are S-shaped.

3. The package set forth in claim 1 wherein said base has a peripheral wall telescopically received over a lower portion of said shell.

4. The package set forth in claim 3 wherein said lower portion of said shell has a reduced diameter for receiving said peripheral wall of said base cup.

5. The package set forth in claim 4 wherein said base is welded to said lower portion of said shell.

6. A package for dispensing a liquid product, which comprises:

an outer shell having a flexible resilient sidewall, a base wall, a finish surrounding an outlet opening, and an opening in said base wall, an inner liner disposed within said outer shell, said inner liner being unattached to said sidewall and said base wall of said outer shell and being collapsible with respect to said outer shell to dispense product within said liner, a dispensing structure secured to said finish, and an atmospheric valve assembly comprising a base secured over said base wall of said outer shell, a valve pocket within said base having an atmospheric vent opening, and a valve disk in said valve pocket for selectively opening and closing said vent opening in response to pressure of air between said outer shell on said inner liner, said valve disk including a periphery secured to said base within said valve pocket, a central portion overlying said vent opening, and a plurality of resilient spokes interconnecting said central portion with said peripheral portion while permitting movement of said central portion with respect to said peripheral portion and said vent opening.

7. A package for dispensing a liquid product, which comprises:

an outer shell having a flexible resilient sidewall, a base wall, a finish surrounding an outlet opening, and an opening in said base wall, an inner liner disposed within said outer shell, said inner liner being unattached to said sidewall and said base wall of said outer shell and being collapsible with respect to said outer shell to dispense product within said liner, a dispensing structure secured to said finish, and an atmospheric valve assembly comprising a base secured over said base wall of said outer shell, a valve pocket within said base having an atmospheric vent opening, and a valve disk in said valve pocket for selectively opening and closing said vent opening in response to pressure of air between said outer shell on said inner liner, said vent opening being centrally disposed in said pocket, and said valve disk having a solid central portion for covering said vent opening and a peripheral portion with arcuate openings for permitting passage of air when said valve disk uncovers said vent opening.

8. The package set forth in claim 7 wherein said disk is flat and of uniform thickness, and central portion is connected to said peripheral portion by spokes, spaces between said spokes forming said arcuate openings.

9. The package set forth in claim 8 wherein said spokes are S-shaped.

10. The package set forth in claim 7 wherein said base has a peripheral wall telescopically received over a lower portion of said shell.

11. The package set forth in claim 10 wherein said lower portion of said shell has a reduced diameter for receiving said peripheral wall of said base.

12. The package set forth in claim 11 wherein said base is welded to said lower portion of said shell.

13. The package set forth in claim 7 wherein said dispensing structure comprises a closure secured to said finish, said closure having an outlet opening constructed to dispense the product in drops when said package is inverted and said sidewall is squeezed.

* * * * *